US006481463B1

(12) United States Patent
Harms

(10) Patent No.: US 6,481,463 B1
(45) Date of Patent: Nov. 19, 2002

(54) CONTROL VALVE WITH MECHANICAL FEEDBACK AND METHOD FOR CONTROLLING FLUID FLOW

(75) Inventor: Louis C. Harms, Evanston, IL (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/574,544

(22) Filed: May 19, 2000

Related U.S. Application Data

(60) Provisional application No. 60/135,204, filed on May 21, 1999.

(51) Int. Cl.[7] ..... F15B 13/16
(52) U.S. Cl. ..... 137/625.65; 91/374; 91/382
(58) Field of Search ..... 91/374, 382; 137/625.65

(56) References Cited

U.S. PATENT DOCUMENTS

| | | | | | |
|---|---|---|---|---|---|
| 2,526,709 | A | * | 10/1950 | Tait | 137/625.63 |
| 2,771,907 | A | * | 11/1956 | Joy | 137/625.63 X |
| 2,969,808 | A | | 1/1961 | Horlacher | |
| 3,875,849 | A | * | 4/1975 | Patel | 91/374 X |
| 4,011,891 | A | * | 3/1977 | Knutson et al. | 137/625.63 X |
| 4,177,713 | A | | 12/1979 | Lewis et al. | |
| 4,375,942 | A | * | 3/1983 | Olson | 91/374 X |
| 4,526,201 | A | * | 7/1985 | Geyler et al. | 137/625.63 |
| 5,836,335 | A | * | 11/1998 | Harms et al. | 137/625.64 X |
| 5,848,612 | A | * | 12/1998 | Currey | 91/374 X |
| 6,039,077 | A | * | 3/2000 | Schulze | 137/625.63 |

FOREIGN PATENT DOCUMENTS

| | | | | |
|---|---|---|---|---|
| DE | 23 32 125 | | 1/1975 | |
| DK | 91304 | * | 7/1961 | 91/374 |
| WO | 97/13074 | | 4/1997 | |

* cited by examiner

*Primary Examiner*—Gerald A. Michalsky
(74) *Attorney, Agent, or Firm*—Renner, Otto, Boisselle & Sklar, LLP

(57) ABSTRACT

A control valve and a method of controlling fluid flow include an input device which provides an input for moving a primary valve member an amount which is a function of the input, thereby opening flow pathways through the valve. The control valve is connected to a mechanical feedback mechanism which moves a feedback valve member an amount which is a function of the movement of a device to which the fluid flow is directed, such as a hydraulic actuator. Movement of the actuator to a desired position causes the second valve member to be moved to such a position that, in combination with the first valve member, the flow pathways through the valve are closed. The actuator is thereby moved to and maintained at the desired position without the need for the electronics feedback sensor used in prior art systems to sense actuator position.

28 Claims, 8 Drawing Sheets

CONTROL VALVE WITH MECHANICAL FEEDBACK AND METHOD FOR CONTROLLING FLUID FLOW

This application claims priority from U.S. Provisional Application No. 60/135,204, filed May 21, 1999.

TECHNICAL FIELD

The invention relates to control valves for fluid power actuators and methods for controlling flow to such actuators. More particularly, the invention relates to control valves and methods for controlling flow that utilize feedback.

BACKGROUND OF THE INVENTION

In many circumstances it is desirable to control movement of a hydraulic actuator over a range of movement, for example by partially extending an actuator and holding it in place. Such partial extension may be accomplished by initiating hydraulic fluid flow to the actuator through a control valve, and by using information from an electronic sensor which senses the actuator position to determine when to shut off flow to the actuator.

However, electronic sensors are unsuitable for certain environments, such as where the actuator and the control valve will be subjected to high temperatures. Accordingly it will be appreciated that a means of accomplishing such partial actuation without use of electronic sensors would be desirable.

SUMMARY OF THE INVENTION

A control valve and a method of controlling fluid flow include an input device which provides an input for moving a primary valve member an amount which is a function of the input, thereby opening flow pathways through the valve. The control valve is connected to a mechanical feedback mechanism which moves a feedback valve member an amount which is a function of the movement of a device to which the fluid flow is directed, such as a hydraulic actuator. Movement of the actuator to a desired position causes the second valve member to be moved to such a position that, in combination with the first valve member, the flow pathways through the valve are closed. The actuator is thereby moved to and maintained at the desired position without the need for the electronic feedback sensor used in prior art systems to sense actuator position.

According to an aspect of the invention, a single-stage fluid flow cartridge control valve includes a cage having openings therethrough; a first valve member internally slidable within the cage; a second valve member internally slidable within the first valve member; and an input mechanism coupled to one of the valve members for moving the one of the valve members; wherein movement of the one of the valve members selectively opens fluid flow pathways between pairs of the openings, and movement of the other of the valve members selectively closes the fluid flow pathways. In a fluid actuator assembly, the other of the valve members is mechanically coupled to an actuator to which fluid is controllably supplied by the control valve.

According to another aspect of the invention, a fluid flow control valve includes a cage having openings therethrough; a first valve member internally slidable within the cage; a second valve member internally slidable within the first valve member, the second valve member having a bore therein and holes therethrough in communication with the bore; and an input mechanism coupled to one of the valve members for moving the one of the valve members; wherein movement of the one of the valve members selectively opens fluid flow pathways between pairs of the openings and movement of the other of the valve members selectively closes the fluid flow pathways, and wherein the holes and the bore are part of a fluid flow pathway between non-adjacent openings. Again, in a fluid actuator assembly, the other of the valve members is mechanically coupled to an actuator to which fluid is controllably supplied by the control valve.

According to a further aspect of the invention, a method of positioning a hydraulic actuator in response to an input signal includes opening flow pathways in a control valve by moving a main spool of the control valve a distance which is a function of the input signal; sending pressurized fluid to one side of the actuator, and draining fluid from the other side of the actuator, through the pathways; and closing the pathways after the actuator has reached a desired position by moving a feedback follower or spool which is mechanically coupled to the actuator.

According to a still further aspect of the invention, an actuator assembly includes an actuator for moving an external member, a control valve which controllably provides fluid to effect movement of the actuator, and a mechanical feedback device which provides actuator position feedback to the control valve.

In a preferred embodiment of the invention, the feedback valve member is internally slideable in and guided by a cage, while the primary or main valve member is internally slideable in the feedback valve member. This arrangement advantageously reduces or eliminates potential binding problems that might arise from side loads being applied to the feedback valve member by the feedback mechanism coupling the feedback valve member to the actuator. Further in accordance with a preferred embodiment, the input device or mechanism is an electric solenoid having the plunger thereof connected, preferably coaxially, to the primary or main valve member.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 1:
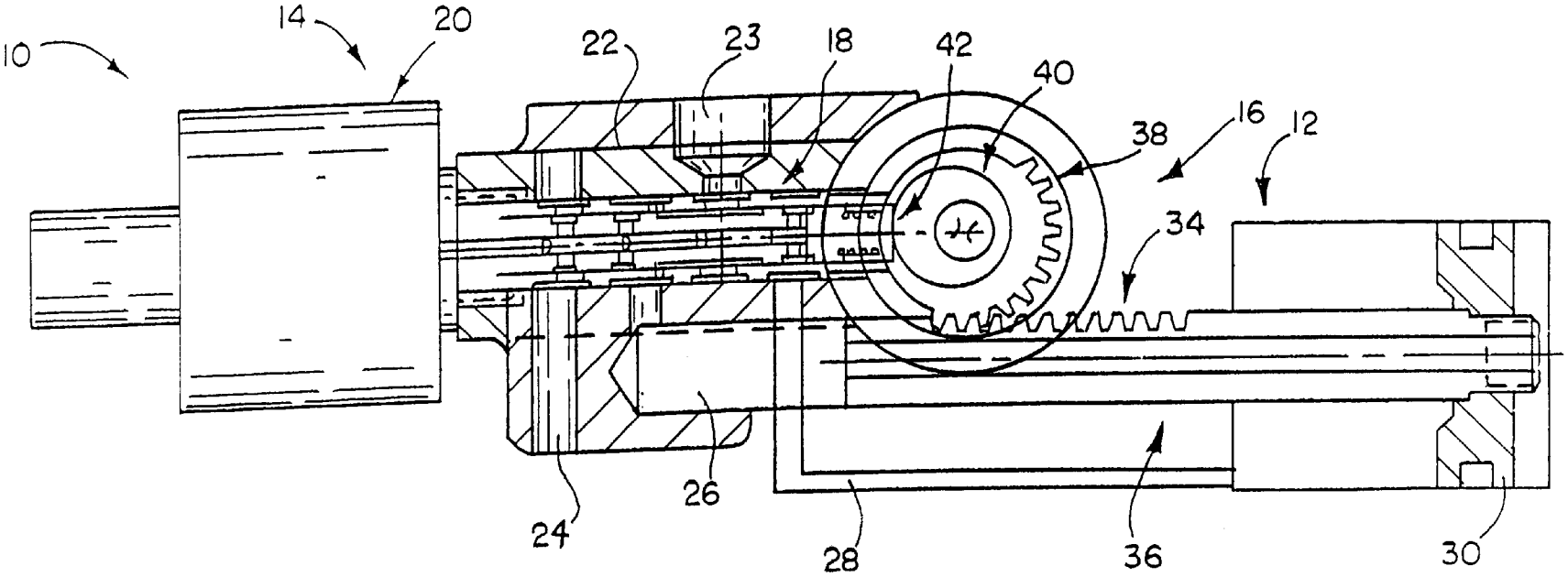
FIG. 1 is a schematic illustration of an actuator assembly using a control valve with mechanical feedback in accordance with the present invention.

Referring now in detail and initially to FIG. 1, an actuator assembly according to the invention is indicated generally at 10. The assembly 10 comprises a fluid power actuator 12, a control valve 14 for selectively providing fluid pressure to move the actuator 12, and a feedback mechanism 16 for providing feedback to the control valve 14 regarding the position of the actuator 12. In the illustrated embodiment, the fluid power actuator 12 is a hydraulic actuator, but the principles of the invention may be applied to other fluid actuators, e.g., pneumatic actuators. The position of the actuator 12 is controlled by the control valve which preferably is a solenoid-type valve that receives electrical control inputs from electrical control circuitry (not shown). Accordingly, the control valve 14 has a valve portion 18 and a solenoid portion 20.

The valve portion 18 of the control valve 14 fits into a manifold 22 which has a pressure port 23 for connection to a high pressure fluid supply and a return or drain port 24 for connection to a low pressure fluid return or drain. In an exemplary embodiment, the length of the portion of the control valve that is inserted into the manifold is approximately 2.5 inches. The manifold 22 also has connections for fluid lines 26 and 28 which run between the manifold 22 and opposite sides of a piston 30 of the actuator 12. By connecting one of the fluid lines 26 and 28 to high pressure and the other of the lines to low pressure, the piston 30 is thereby moved (the fluid actuator is extended or retracted) to do useful work.

The feedback mechanism 16 provides mechanical feedback to the control valve 14 regarding the position of the piston 30. The illustrated feedback mechanism 16 includes a rack 34 on a rod 36 which is connected to the piston 30. A pinion 38 meshes with the rack 34 and thus translation of the rod 36 is converted to rotational motion of the pinion 38. The pinion 38 is connected to an eccentric cam 40 which rotates along with the pinion. The eccentric cam 40 is in contact with the control valve 14, so that rotation of the eccentric cam 40 causes displacement of a control valve contact surface 42 which is in contact therewith.

As explained in greater detail below, the control valve 14 receives an input signal which shifts internal parts of the control valve so as to provide high pressure fluid through one of the fluid lines 26, 28, with the other of the fluid lines 26, 28 connected to return. Movement of the piston 30 moves other internal parts of the control valve 14 via the feedback mechanism 16. After the piston 30 has moved a given amount, the given amount being a function of the input signal magnitude, the internal parts of the control valve 14 align so as to block further flow of fluid to the actuator 12, thus stopping further movement of the piston within the actuator.

Figure 2:
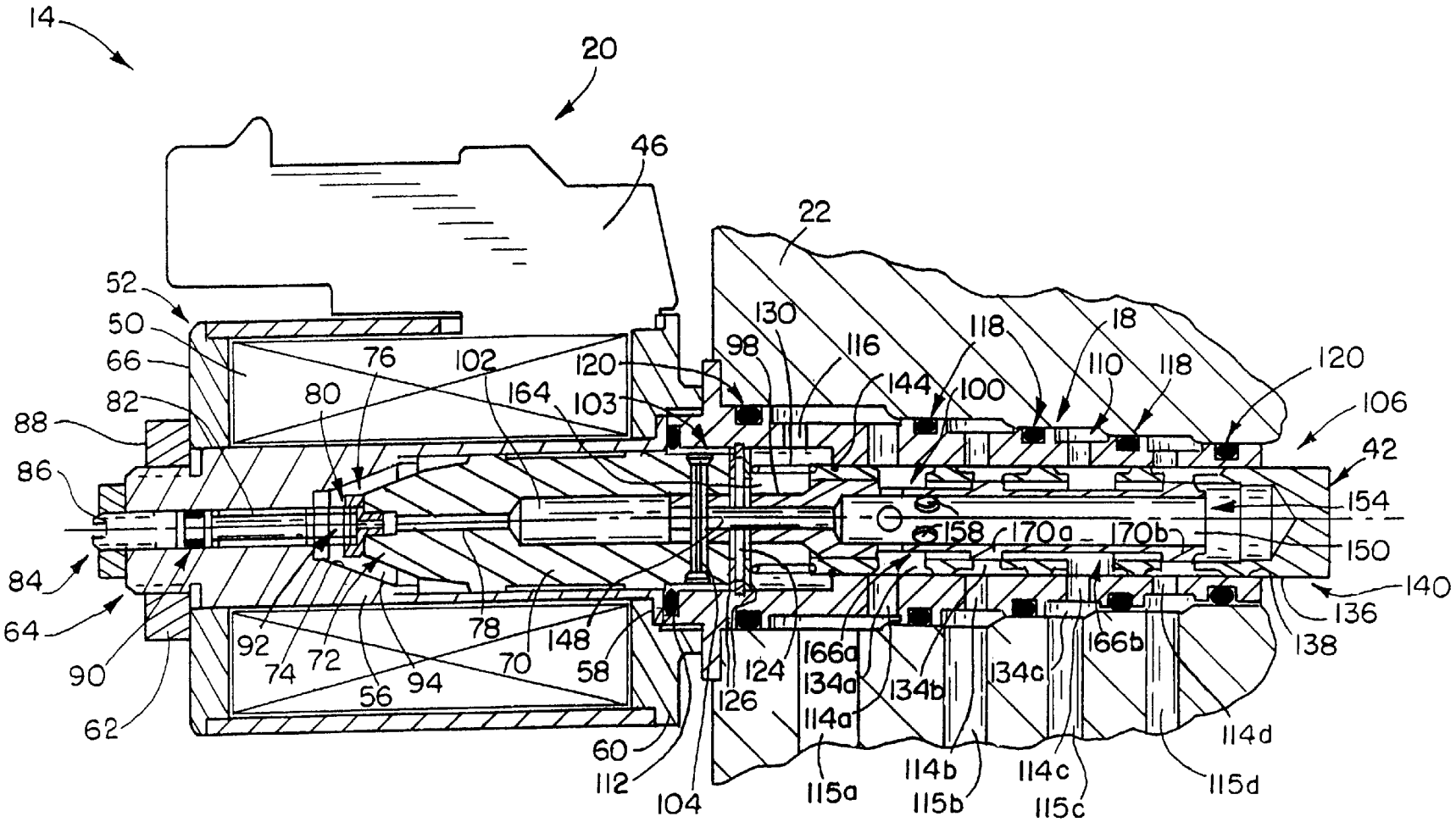
FIG. 2 is a cross-sectional view of the control valve of FIG. 1.

Details of the control valve 14 are shown in FIG. 2. The solenoid portion 20 includes an input section 46 which receives an input such as an electrical signal. The input from the input section 46 is then used in energizing a coil 50 which is at least partially within a housing 52. Preferably the current used to energize the coil 50 is a function of the strength of the input signal, and may be proportional to the input signal. For example, the input signal may be a variable current which is used to energize the coil 50.

A tube 56 is located within the housing 52, surrounded by the coil 50. The tube 56 is held in a fixed position within the housing 52 using a tube flange 58 at one end of the tube which is pulled against an adapter 60 which is part of the housing 52. This pulling is accomplished by means of a nut 62 which mates with an externally-threaded opposite end 64 of the tube 56, the nut 62 being tightened against end plate 66 of the housing 52.

A plunger 70 is slidable within the tube 56. The plunger 70 has a conically-shaped end 72 which corresponds in shape to a conical interior surface 74 of the tube 56. At the conically-shaped end 72 a stop 76 is coupled to the plunger 70, the stop 76 fitting into a narrow plunger bore 78. The stop 76 has a stop recess 80 at its distal end for receiving a spring 82. The spring 82 pushes the stop 76 into and against the plunger 70, and urges the plunger 70 rightward as shown in FIG. 2. The spring force may be adjusted using an adjustment mechanism 84, in which an externally-threaded adjuster 86 is positioned within a nut 88 to increase or decrease the compression of the spring 82.

An O-ring 90 provides sealing between the adjustment mechanism 84 and the interior of the tube 56. The O-ring is of a conventional design, and is made of conventional materials compatible with the fluid used and able to withstand the environment to which the control valve is to be exposed. For example, the O-ring material may and should be selected to be able to withstand temperature extremes to which the control valve will be subjected.

The plunger 70 is preferably made of a ferromagnetic material such as steel. Generally, the other parts of the control valve 14 are made out of steel, although it will be appreciated that other rigid metallic or non-metallic materials which are suitable for use may alternatively be employed.

Current in the coil 50 induces a magnetic field which pulls the plunger 70 against the force of the spring 72 (leftward in FIG. 2). As is preferred, the magnetic field, and thus the magnetic force on the plunger 70, is linearly proportional to the current in the coil 50. The spring force in the spring 72 is (to a first approximation) a linear function of the amount of compression. Therefore, beyond a certain minimum current in the coil 50 which is required to initiate movement of the plunger 70, displacement of the plunger 70 increases linearly with increasing current in the solenoid. Those skilled in the art will appreciate that a non-linear response may be provided, if desired, by modifying the solenoid coil, plunger, and/or spring.

The stop 76 prevents the plunger 70 from coming into contact with the interior surface 74 of the tube 56. Such contact can lead to latching, a magnetic coupling of the tube 56 and the plunger 70. Further, the stop 76 has a stop bore 92 therethrough which allows free flow between the narrow plunger bore 78 and a gap 94 between the conically-shaped end 72 and the conical interior surface 74. This equalizes pressure on both sides of the plunger 70 and prevents pressure changes in the gap 94 due to movement of the plunger 70; unequal pressures or pressure changes might affect the operating characteristics of the valve.

At its end 103 opposite the stop 76, the plunger 70 has a plunger bore 102. Fitted in the bore 102 is a narrow end 98 of a primary or main valve member 100, the main valve member being a part of the valve portion 18. The narrow end 98 is connected to the plunger 70 by a roll pin 104.

As is preferred, the main valve member 100 is in the form of a main spool. The main spool 100 is internally slideable in a feedback valve sleeve or spool 106 which functions as a feedback valve member or follower of the illustrated control valve 14. The feedback valve spool 106 is internally slideable in a cage 110 that is fixedly connected to the adapter 60. The connection between the cage 110 and the adapter may include, for example, a threaded connection. An O-ring 112 provides sealing between the cage 110 and the adapter 60.

It is noted here that the control valve 14 preferably is provided in the form of a cartridge that may be installed as a unit in the manifold 22 or other housing. Also, although not preferred, the solenoid portion 20 may be replaced by other input mechanisms suitable for moving the main valve member 100 of the valve portion 18 in response to a command prompt.

The cage 110 provides the connection between the control valve cartridge 14 and the manifold 22. The cage 110 has series of holes 114*a*–114*d* corresponding to the locations of the passages 115*a*–115*d* in the manifold 22. The passages 115*a*–115*d* are respectively connected to the ports 23, 24, 26, and 28. The holes 114 and associated annular grooves allow passage of fluid through the cage 110 as appropriate. Each of the series of holes 114 has one or more holes circumferentially spaced around the cage 110. A hole 116 is used to provide pressure equalization on the plunger 70, as will be explained further below.

The cage 110 has annular sealing ribs or protrusions 118 between adjacent pairs of the holes 114*a*–114*d*. Each of the sealing ribs 118 has an O-ring seal to prevent fluid from passing directly from one passage in the manifold 22 to another. Additional sealing ribs 120 are provided in the cage 110 to prevent leakage of fluid outside of the manifold 22. The sealing ribs 118 and 120 preferably have different diameters that correspond to stepped ledges in the manifold 22. This "stepped" cage and manifold are used to avoid the risk that the O-rings of the sealing ribs 118 and 120 will be cut by the edges of the passages 115*a*–115*d* in the manifold 22.

The cage 110 has a circumferential groove along its interior surface for holding a retaining ring 124 therein. Washers 126 are located on either side of the retaining ring 124. The retaining ring 124 and the washers 126 provide a fixed stop that limits motion of the plunger 70. In addition, the retaining ring 124 and the washers 126 fix the location of one end of a spring 130, the other end of which presses on an end surface 132 of the feedback spool 106.

The feedback spool 106 has a series of openings 134*a*–134*d* and associated annular grooves which communicate with respective of the holes 114*a*–114*d* in the cage 110. The openings 134 are preferably somewhat longer than the holes 114 in order to maintain a fluid path between respective openings 134 and holes 114 as the feedback spool 106 axially moves relative to the cage 110. The openings 134 may be, for example, a series of circumferentially-spaced holes about the feedback spool 106 at axial locations corresponding to the holes 114.

An external sliding surface 136 of the feedback spool 106 fits closely against its counterpart internal surface 138 of the cage 110 to prevent flow between the feedback spool 106 and the cage 110. A close fit between the surfaces 136 and 138 provides a sufficiently good seal to prevent external leakage or undesired internal flow between passages 115*a*–115*d* of the manifold 22. The close fit also allows the cage to carry any side loads applied to the feedback spool that might otherwise cause cocking and possible binding of the feedback spool 106 or the main spool 100 which slides in the feedback spool.

The feedback spool 106 has a closed cam follower end 140 which protrudes from the remainder of the control valve 14. The contact surface 42 of the closed end 140 is designed to contact the feedback mechanism 16 such as the eccentric cam 40 (FIG. 1). The contact surface preferably is flat but it will be appreciated that the contact surface may have a curved or other non-flat shape if desired.

The feedback spool 106 has attached thereto, at an annular groove, a retaining ring 144. The retaining ring 144 has an outside diameter greater than the inside diameter of the cage 110. This limits the travel of the feedback spool 106 and thereby limits the amount by which the closed end 140 protrudes from the remainder of the control valve 14.

Still referring to FIG. 2, the main spool 100 is hollow, having a narrow (small diameter) spool bore 148 in its narrow spool end 98 and a wide spool bore 150 in its wide spool end 154. The bores 148 and 150 are connected to each other and thus provide a passage for fluid to flow through the main spool 100, as well as providing a passageway for fluid to flow between either end of the main spool 100 and spool holes 158 in the main spool 100.

The holes 158 communicate with a passage 115*a* in the manifold 22 which is maintained at relatively constant pressure, such as at a system drain (return) pressure, via the openings 134*a* in the feedback spool 106 and the cage holes 114*a* in the cage 110. Thus the gap 94 between the conically-shaped end 72 and the conical interior surface 74 is maintained at that same pressure, since the gap 94 and the spool holes 158 are linked via the stop bore 92, the plunger bores 78 and 102, and the spool bores 148 and 150. The opposite end 103 of the plunger 70 is also maintained at the same pressure, since a volume 164 is communication with the opposite end 103 of the plunger 70 via central apertures in the retaining ring 124 and the washers 126, and the volume 164 is also in communication with the passage 115*a* via the holes 116 in the cage 110. Thus both sides of the plunger 70 are maintained at the same pressure, so that movement of the plunger does not cause pressure changes on one or both sides thereof that might affect the operating characteristics of the valve 14, and further to pressure balance the plunger.

It will be appreciated that the valve may alternatively be configured for using any of the passages in the manifold as the source of the pressure for equalizing pressure on both sides of the plunger, and that the pressure source for the equalization need not provide constant pressure.

The main spool 100 has recessed regions (annular grooves) 166*a* and 166*b* and cover portions (annular lands) 170*a* and 170*b*. The recessed regions 166*a* and 166*b*, depending on the relative orientation of the main spool 100 and the cage 110, can provide a flow pathway or passageway linking adjacent of the openings 134*a*–134*d* in the feedback spool 106. The recessed regions 166*a* and 166*b* need not necessarily be recessed fully about the circumference of the main spool 100, but may for example be grooves or channels in a region which is otherwise not recessed.

The cover portions 170*a* and 170*b* are sufficiently axially long enough to cover the respective openings 134*b* and 134*d* of the feedback spool 106. Thus when the main spool 100 and the feedback spool 106 are positioned such that the cover portions 170*a* and 170*b* block flow through the openings 134*b* and 134*d*, there is no flow of fluid to or from the actuator 12, and the position of the actuator 12 is maintained. This no-flow condition is referred to as a "null" condition of the valve 14. Such a null condition is the default condition when no input signal is applied to the control valve. A null condition also occurs when the cover portions 170*a* and 170*b* and the openings 134*b* and 134*d* are aligned due to displacement of the feedback spool 106 by the feedback mechanism 16 when the desired position of the piston 30 is achieved, as explained in greater detail below.

It will be appreciated that alternatively the control valve may provide flow when no current or other input is provided, rather than being in a null condition.

Preferably the cover portions 170*a* and 170*b* are only slightly larger than their respective openings 134*b* and 134*d*. The greater the overlap between the cover portions 170*a* and 170*b* and the areas around the respective openings 134*b* and 134*d*, the slower the response of the control valve 14 to an input signal. More overlap means more motion of the main spool 100 is required to initiate flow.

Figure 3A:
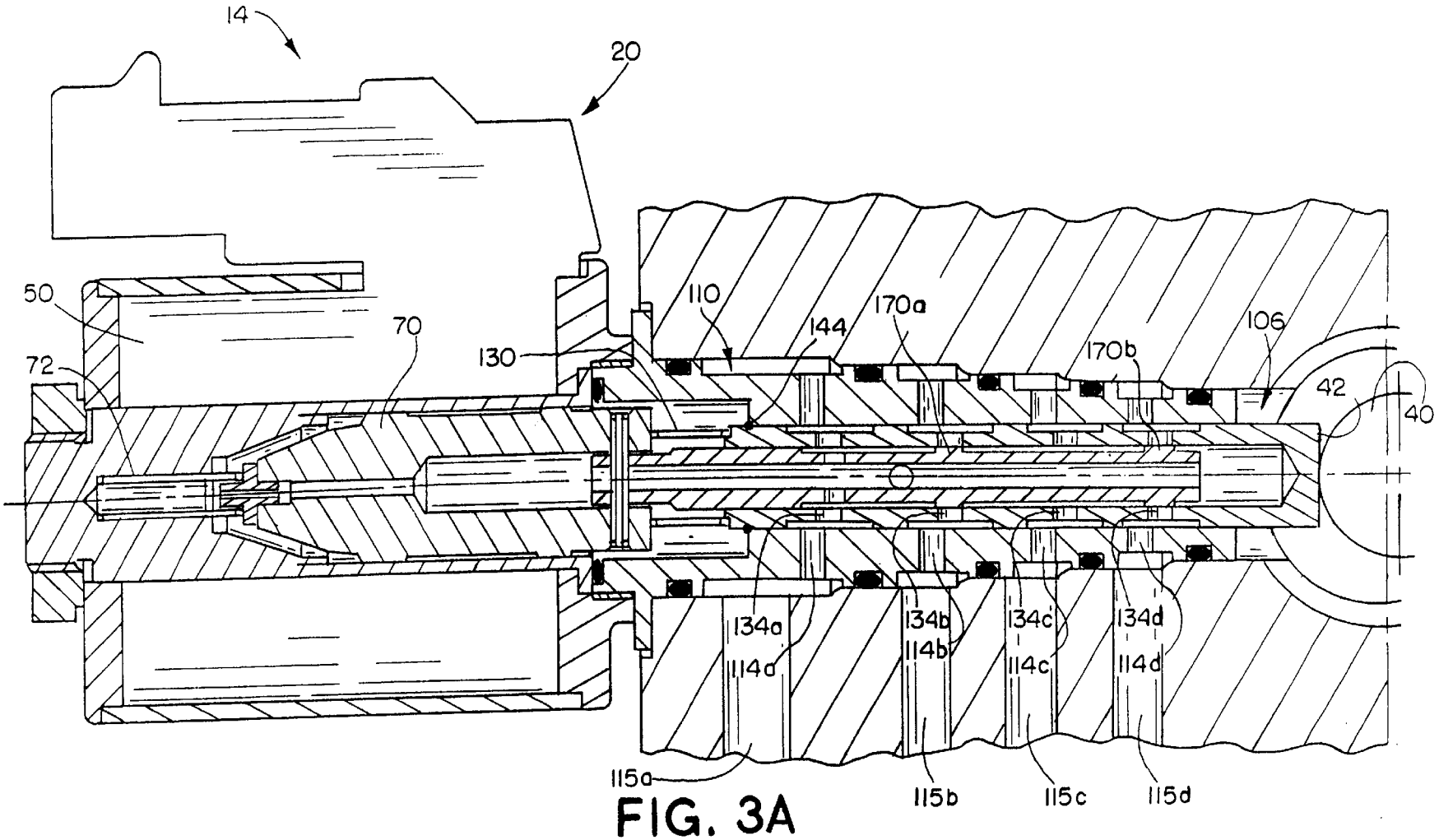
FIGS. 3A–3C are cross-sectional views showing different operational positions of the control valve, some parts of which have been removed or modified for clarity of illustration.
Figure 3B:
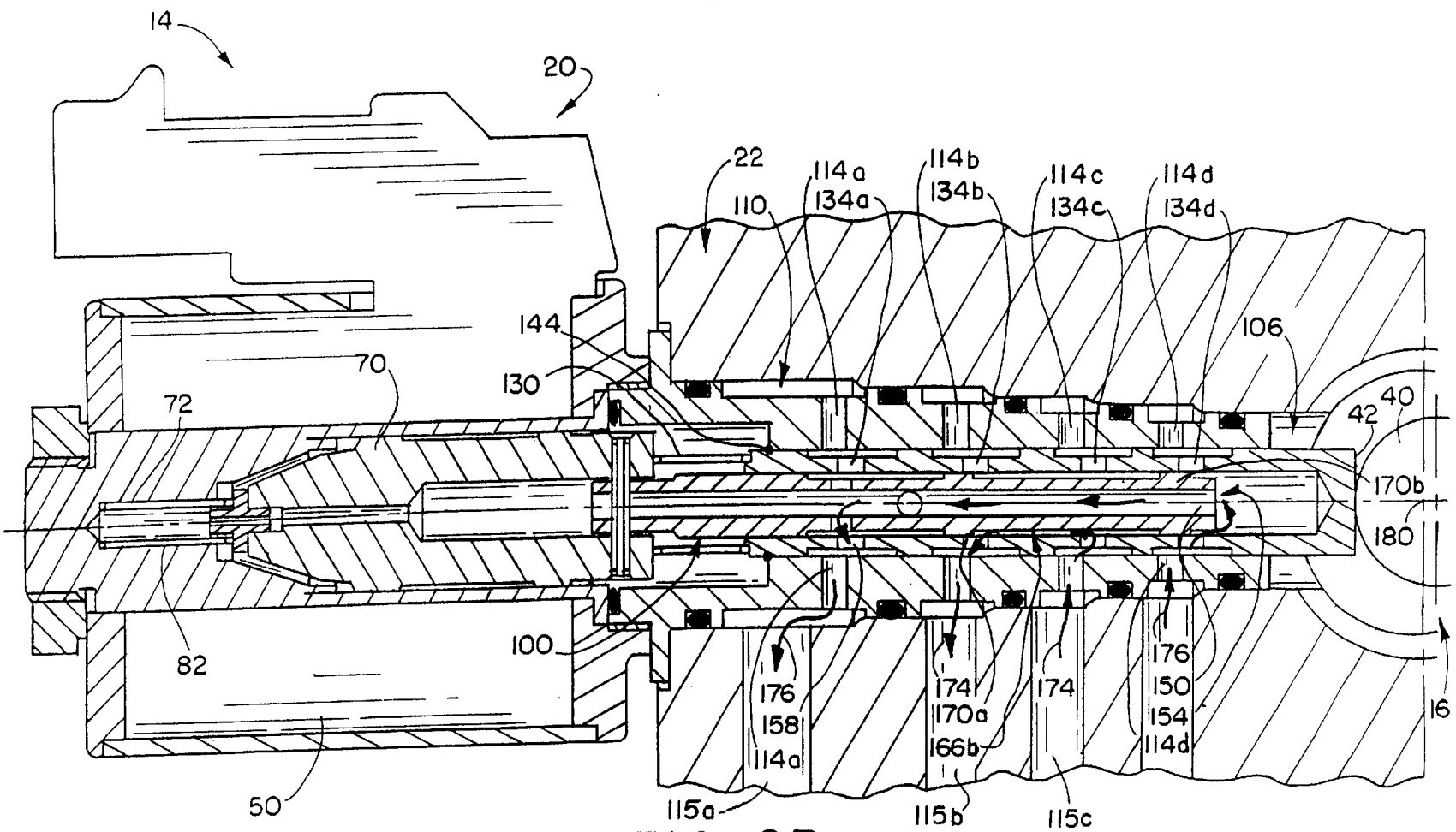
Figure 3C:
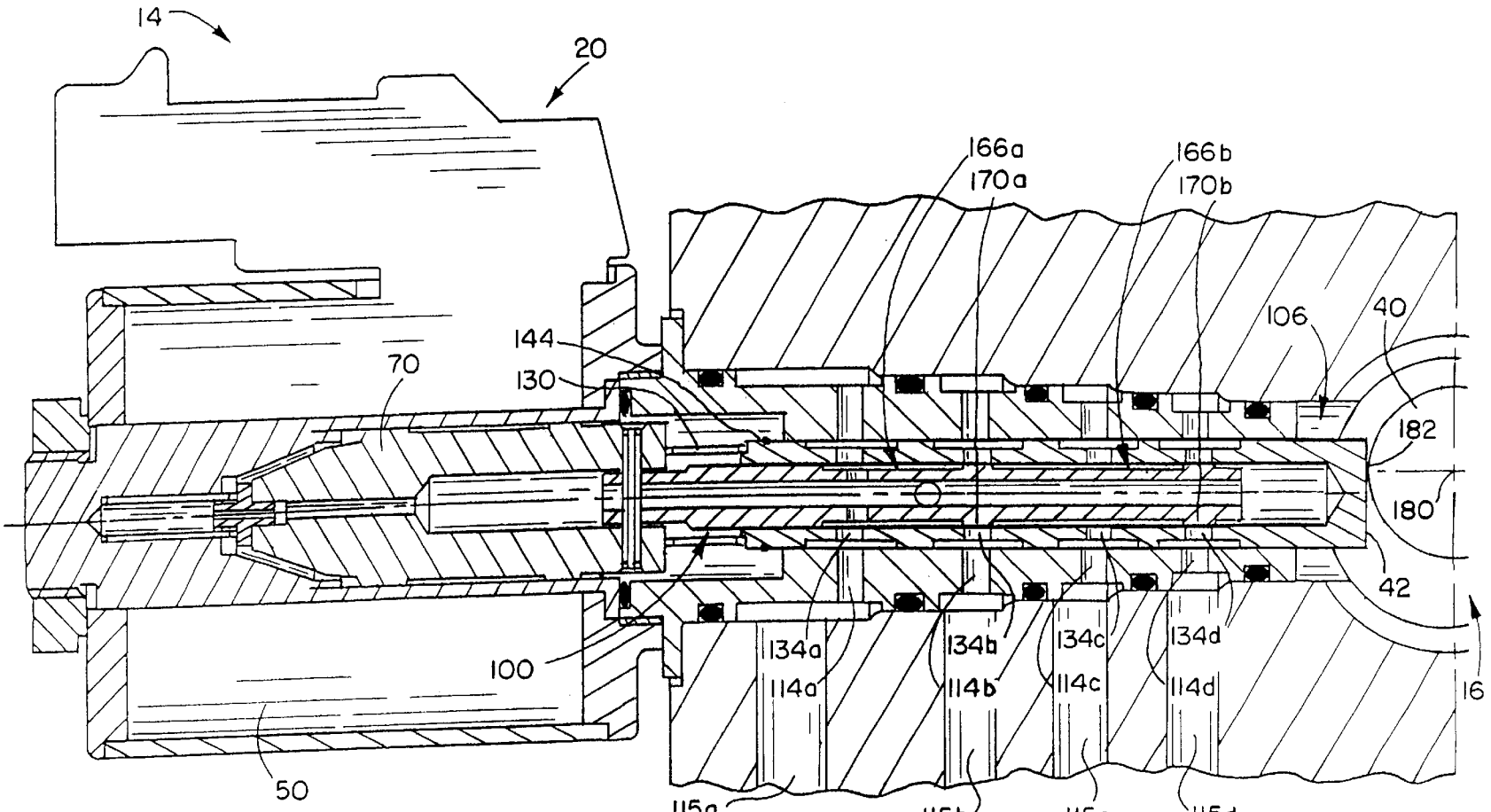

FIGS. 3A–3C illustrate operation of the fluid control valve cartridge 14. In FIG. 3A the control valve 14 is shown with no current applied to solenoid portion 20, and with the actuator 12 fully retracted. The valve 14 is in a null position, with cover portions 170*a* and 170*b* overlapping respective openings 134*b* and 134*d*, and blocking flow through the control valve 14. The actuator being fully retracted corresponds to the eccentric cam 40 oriented so that surface 42 of feedback spool 106 protrudes a maximum amount from the remainder of the valve 14, with retaining ring 144 against its stop on cage 110.

FIG. 3B shows the configuration of the control valve 14 when an input current has been applied and the actuator 12 is extending. The magnetic field produced by the current through the coil 50 causes plunger 70 to move leftward, further compressing spring 72. The main spool 100 likewise moves to the left. This causes the cover portions 170*a* and 170*b* to move at least partially off of the openings 134*b* and 134*d*, providing flow passageways within the valve 14 for fluid to flow to and from the actuator 12.

Fluid from high pressure passage 115*c* in the manifold 22 flows through hole 114c in the cage 110, through openings 134c in the feedback spool 106, along recessed region 166*b* of the main spool 100, through openings 134*b* and holes 114*b* to passage 115*b* which is linked to port of the actuator for extending the actuator. This path is indicated by arrows 174 in FIG. 3B.

Fluid from the other port of the actuator enters passage 115*d* of the manifold, passes through holes 114*d* and openings 134*d* into bore 150 in open end 154 of the main spool 100, along the bore 150 and through spool holes 158, openings 134*a*, and holes 114*a* into drain line (low pressure) passage 115*a*. This path is indicated by arrows 176.

In response to the movement of the actuator the eccentric cam 40, part of the feedback mechanism 16, rotates counterclockwise about an axis 180. This rotation of the eccentric cam 40 pushes the feedback spool 106 leftward, thereby causing the cover portions 170*a* and 170*b* to gradually cover the openings 134*b* and 134*d*. Eventually, when the actuator has reached the desired position, the movement of the feedback spool 106 by the feedback mechanism 16 causes the valve 14 to again reach a null condition, as shown in FIG. 3C.

In FIG. 3C it is seen that the feedback spool 106 has moved leftward, with the retaining ring 144 off its stop on the cage 110. The cover portions 170*a* and 170*b* fully cover the openings 134*b* and 134*d*, preventing any further flow to or from the actuator, and locking the actuator in its desired position.

As the eccentric cam 40 rotates, friction forces between the cam 40 and the contact surface 42 of the feedback spool 106 will exert a lateral force on the feedback spool 106. In addition rotation of the eccentric cam 40 causes a contact point 182 between the cam 40 and the contact surface 42 to move away from the centerline of the feedback spool 106, which also leads to a lateral force on the feedback spool 106.

Since the feedback spool 106 is between the main spool 100 and the cage 110, these lateral forces do not tend to trap the main spool or cause it to bind, as might happen if the main spool was between the cage 110 and the feedback spool. However, it will be appreciated that the feedback spool might alternatively be slidable within the main spool, rather than vice versa, if the risk of binding or added wear was considered acceptable.

It will be appreciated that the actuator 12 may be retracted in whole or in part by reversing the steps outlined above. Making reference to the null extended condition of the valve 14 shown in FIG. 3C, reducing or removing the input current would cause the magnetic field produced by the coil 50 to be reduced or eliminated, which would cause the spring 82 to reposition the plunger 70 and the main spool 100 rightward, with the main spool 100 sliding within the feedback spool 106.

Movement of the main spool 100 causes the cover portions 170*a* and 170*b* to move off of the openings 134*b* and 134*d*, with the passages 115*a* and 115*b* connected together via a flow passageway which includes the recessed region 166*a*, and the passages 115*c* and 115*d* connected together via a flow passageway which includes the recessed region 166*b*.

As the actuator retracts the eccentric cam 40 rotates clockwise due to the action of the feedback mechanism 16. This rotation of the eccentric cam 40 allows the feedback spool 106 to move rightward under the action of the spring 130. This rightward movement of the feedback spool 106 causes the cover portions 170*a*, 170*b* to gradually cover the openings 134*b*, 134*d*, at which point the actuator 12 has reached its desired position and the valve 14 is again in a null configuration, with no further flow to or from the actuator.

In an exemplary application, the above-described control valve may be used as part of a system for adjusting vanes of a turbocharger via a hydraulic actuator. Turbocharger temperatures can reach 1200° F., and an electronic feedback system for such an actuator would be unable to withstand the thermal environment created by close proximity to the turbocharger.

It will be appreciated that the embodiments described heretofore are merely exemplary, and that numerous variations that would occur to one skilled in the art are embraced by the invention. For example, numerous parts are described above as involving narrower and wider portions and/or bores, but it will be appreciated that relative widths of the portions and/or the bores may be reversed or otherwise altered.

Further, it will be appreciated that many variations of the configuration of the ports in the manifold are possible, although it is preferable that the pressure/drain passages alternate with the passages for the hydraulic lines to the actuator.

While the embodiments described above have been generally related to a control valve for a hydraulic actuator, a control valve of the present invention may also be usable with a pneumatic system for delivering a pressurized gas in order to do work.

The invention may be used with a wide variety of work-performing devices in place of the actuator described above, as long as the work-performing device is able to provide movement that can be used for the feedback mechanism.

The feedback mechanism may include a wide variety of mechanical couplings and/or linkages, for instance belts, pulleys, levers, many varieties of gears, etc. The feedback mechanism may have a linear or nonlinear feedback between movement of the actuator or other device and movement of the feedback follower. The feedback mechanism may provide feedback which moves the cam follower substantially the same distance that the actuator moves.

A mechanical input device may be substituted for the solenoid portion, if desired, with the design altered as necessary.

It will be understood that a variety of known resilient biasing devices may be used in place of the coil springs shown in the illustrated embodiments.

What follows below are descriptions of some alternate embodiment cartridge control valves of the present invention, description of some similar features being omitted below for the sake of brevity.

Figure 4:
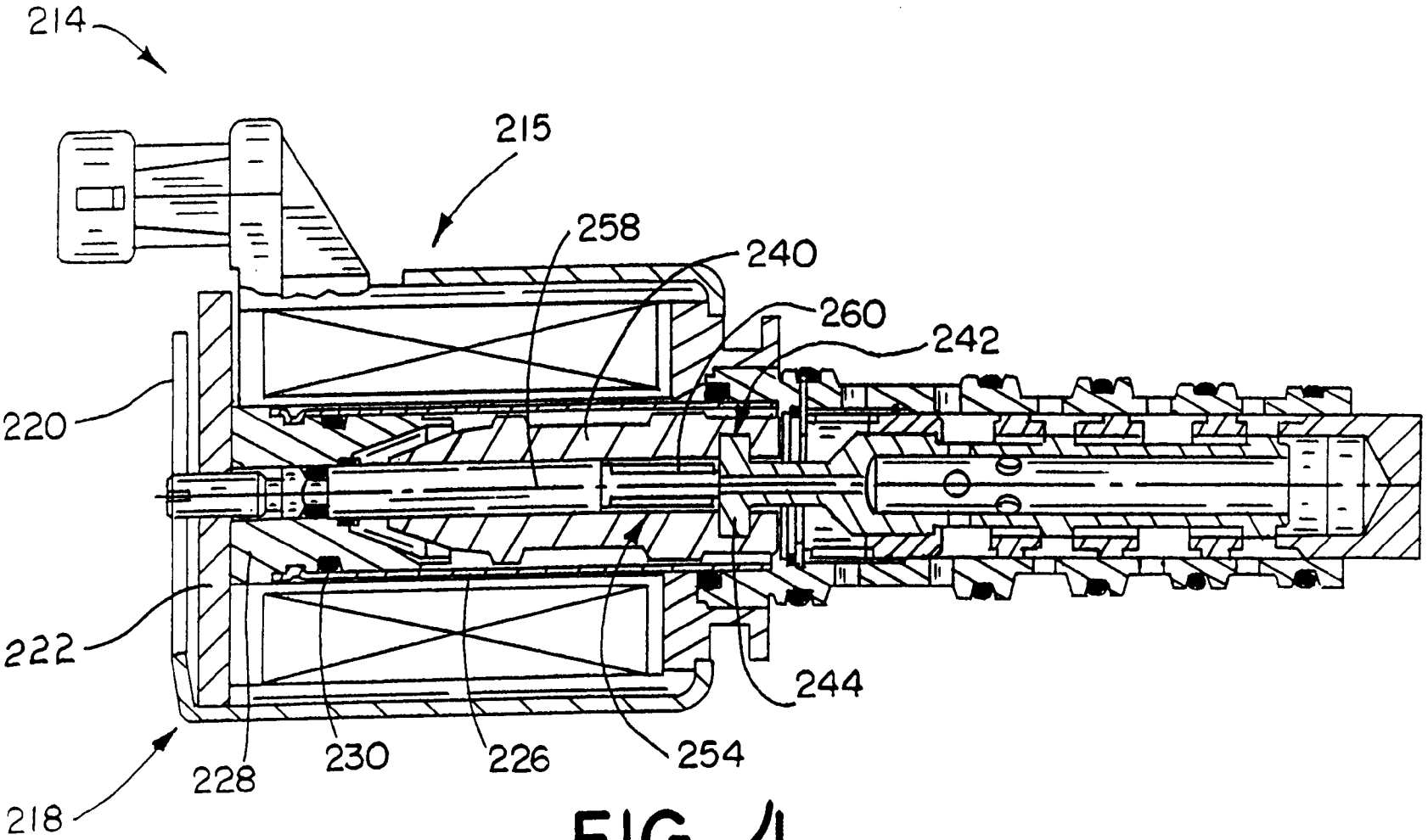
FIG. 4 is a cross-sectional view of another embodiment of control valve according to the present invention.

FIG. 4 shows a control valve 214 which has a solenoid portion 215 with a housing 218 which has a folded portion 220 for holding a washer 222 in place at one end. The solenoid portion 215 also has a tube 226 which is crimped onto a pole piece 228, with an O-ring 230 sealing the connection between the tube 226 and the pole piece 228. This collection of parts substitutes for the tube 56 of the control valve 14.

Plunger 240 has a T-shaped slot 242 for receiving a T-shaped protrusion 244 on one end of a main spool 250. The plunger 240 has a central bore 254 therethrough, the bore 254 being in communication with the slot 242. A pin 258 is located in the bore 254. A spring 260 between the pin 258 and the protrusion 244 provides biasing for the location of the plunger 240 and the main spool 250.

Figures 5, 6A, 6B:
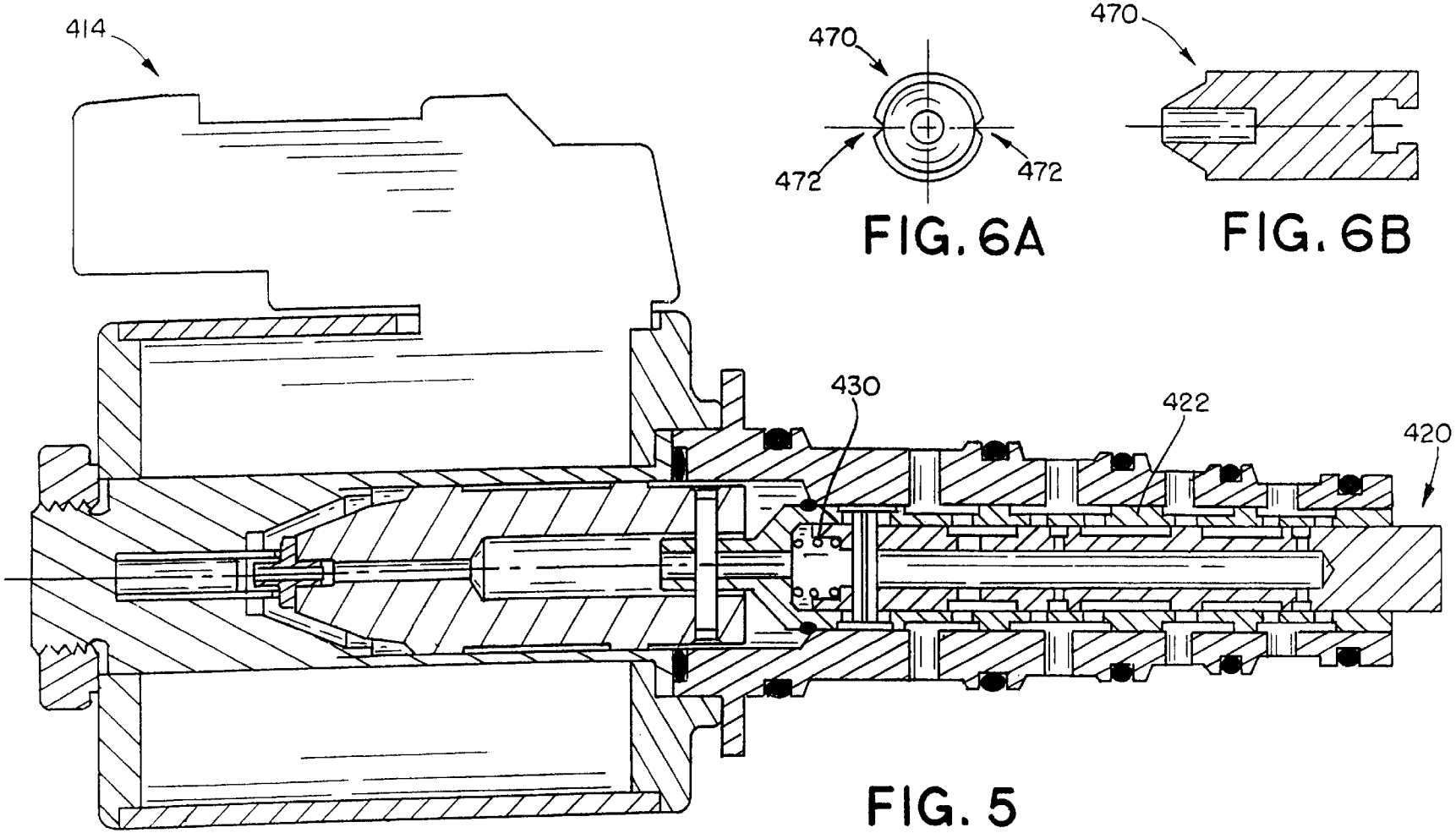
FIG. 5 is a cross-sectional view of yet another embodiment of control valve according to the present invention.
FIGS. 6A and 6B are an end view and a cross-sectional view, respectively, of an alternate embodiment plunger.

Referring to FIG. 5, an alternate embodiment cartridge control valve 414 has a cam follower 420 which slides within a main spool or sleeve 422. A spring 430 between the cam follower 420 and the main spool or sleeve 422 provides a force which biases the cam follower 420 to protrude from the remainder of the control valve 414.

FIGS. 6A and 6B show an alternate embodiment plunger 470 which has grooves 472 in an axial direction along its external surface. The grooves 472 allow the pressures on both sides of the plunger 470 to be maintained equal without the necessity of boring a hole or otherwise providing a flow passage through the plunger.

Figure 7:
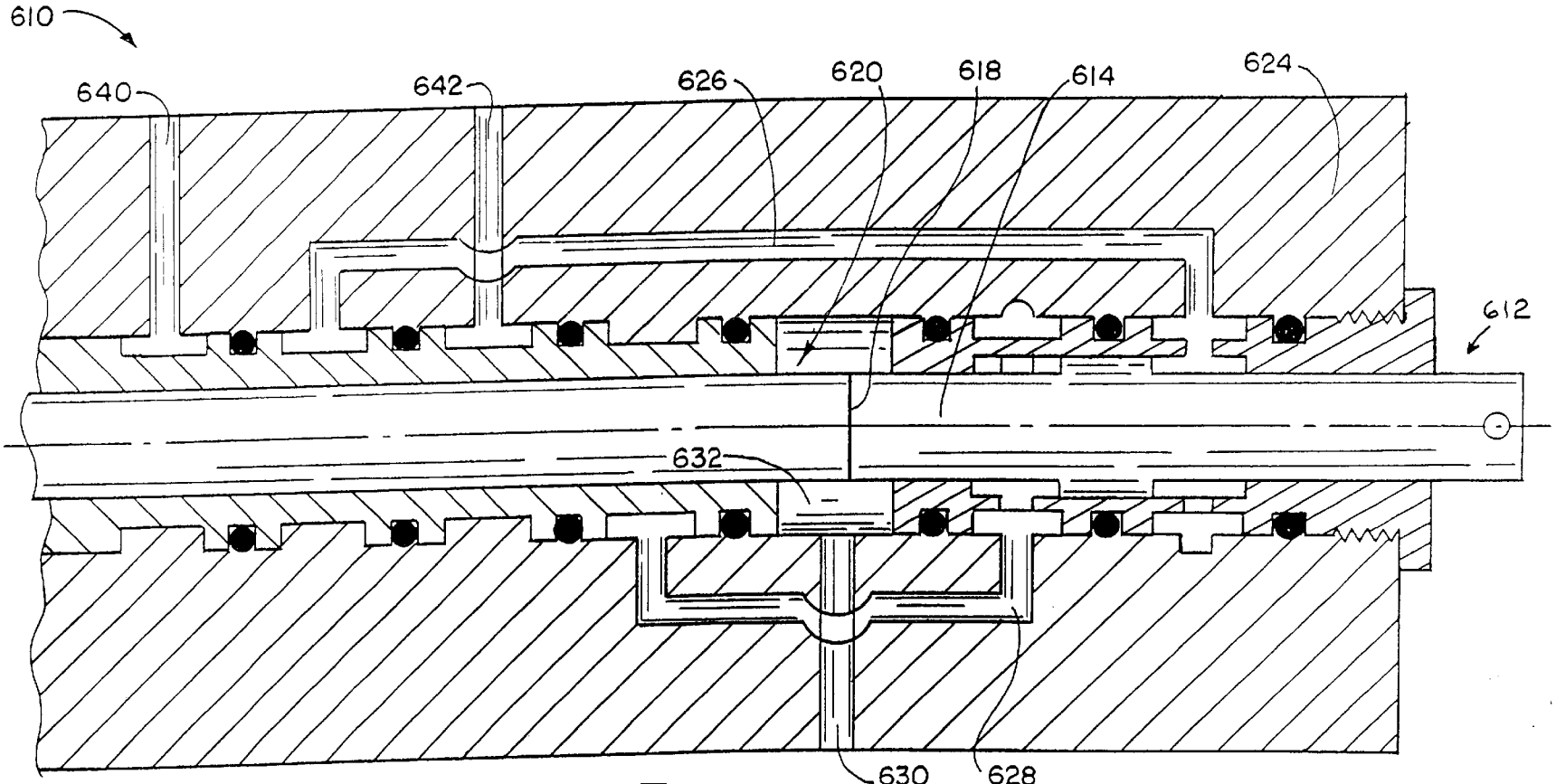
FIG. 7 is a cross-sectional view of a further embodiment of the present, invention.

Referring to FIG. 7, a feedback control system 610 is shown in which a fluid actuator 612 has an integral feedback member 614 directly in contact with a contact surface 618 of a control valve 620, the control valve 620 being a valve of the type described above. The actuator 612 and the control valve 620 may both be housed in a manifold 624, with fluid connections between the actuator 612 and the control valve 620 being passages 626 and 628 in the manifold 624. The manifold has a vent 630 which is in communication with a volume 632 in which the feedback member 614 and the control valve 620 meet.

An input signal to the control valve 620 causes the passages 626 and 628 to be connected to pressure and drain (return) passages 640 and 642 in the manifold 624 such that pressure is applied to extend or retract the actuator 612. Movement of the actuator 612 causes movement of the feedback member 614, which in turn moves the contact surface 618 which is part of a feedback follower or spool. In a manner similar to that described above in connection with FIGS. 3A–3C, the control valve 620 reaches a null state when the desired actuator position is reached.

It will be appreciated that the feedback member may alternatively be a separate part that is attached or otherwise connected to the fluid actuator. It will further be appreciated that the actuator and the control valve may be housed in different manifolds, or that fluid lines may used in connecting the actuator and the control valve, if desired.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A single-stage fluid flow cartridge control valve comprising:

a cage having openings therethrough;

a first valve member internally slidable within the cage;

a second valve member internally slidable within the first valve member; and an input mechanism coupled to the second valve member for moving the second valve member, wherein movement of the second valve member selectively opens fluid flow pathways between pairs of the openings, and movement of the first valve member selectively closes the fluid flow pathways;

wherein the first valve member is a cam follower; and wherein the second valve member is a main spool having a bore forming part of the fluid flow pathways.

2. The flow control valve of claim 1, further comprising a spring which biases position of the cam follower.

3. The control valve of claim 2, wherein the input mechanism is a solenoid which includes a coil, and a plunger within the coil which moves in response to a magnetic field induced by current flowing through the coil, and wherein the spring is operatively coupled to the plunger for biasing position of the plunger.

4. The flow control valve of claim 1, wherein the input mechanism is a solenoid which includes a coil and a plunger within the coil which moves in response to a magnetic field induced by current flowing through the coil.

5. The flow control valve of claim 4, further comprising a spring operatively coupled to the plunger for biasing position of the plunger.

6. The flow control valve of claim 1, wherein the cage is a stepped cage.

7. The control valve of claim 1, wherein the cam follower has a flat contact surface that is substantially perpendicular to an axis of the cam follower.

8. A fluid flow control valve comprising:

a cage having openings therethrough;

a first valve member internally slidable within the cage;

a second valve member internally slidable within the first valve member, the second valve member having a bore therein and holes therethrough in communication with the bore; and an input mechanism coupled to the first valve member for moving the second valve member;

wherein movement of the second valve member selectively opens fluid flow pathways between pairs of the openings and movement of the first valve member selectively closes the fluid flow pathways;

wherein the holes and the bore are part of a fluid flow pathway between nonadjacent openings; and wherein the first valve member is a cam follower and the second valve member is a main spool.

9. The flow control valve of claim 8, wherein the input mechanism is a solenoid which includes a coil and a plunger within the coil which moves in response to a magnetic field induced by current flowing through the coil.

10. The flow control valve of claim 9, further comprising a spring operatively coupled to the plunger for biasing position of the plunger.

11. The control valve of claim 8, wherein the cam follower has a flat contact surface that is substantially perpendicular to an axis of the cam follower.

12. A single-stage fluid flow control valve comprising:

a manifold having a first input passage for coupling to a high pressure line, a second input passage for coupling to a low pressure line, and a pair of output passages for coupling to respective chambers of an actuator;

a follower and a main spool independently slidable within the manifold; and a plunger connected to the main spool, and at least partially within a solenoid, whereby the solenoid is operatively coupled to the main spool for positioning the main spool;

wherein the follower has a contact surface protruding from the manifold. such that the follower may be positioned by positioning the contact surface;

wherein the follower and the main spool are configured to define blockable flow passages between the first input passage and each of the output passages, and between the second input passage and each of the output passages; and wherein the contact surface is a flat contact surface.

13. The control valve of claim 12, wherein the main spool is slidable within the follower.

14. The control valve of claim 12, wherein the flat contact surface is substantially perpendicular to an axis of the follower, whereby the flat contact surface is configured to engage a cam.

15. The control valve of claim 12, wherein the main spool has a spool bore therethrough forming part of at least one of the flow passages.

16. The control valve of claim 15, wherein the input passages and the output passages are arrayed substantially linearly in a side-by-side arrangement within the manifold, wherein the flow passages include a connection via the spool bore between one of the input passages, and one of the output passages that is not adjacent to the one of the input passages.

17. The control valve of claim 15, wherein the spool bore is in communication with a plunger bore through the plunger.

18. A single-stage fluid flow control valve comprising:

a manifold having a first input passage for coupling to a high pressure line, a second input passage for coupling to a low pressure line, and a pair of output passages for coupling to respective chambers of an actuator;

a follower and a main spool independently slidable within the manifold, wherein the follower has a contact surface protruding from the manifold, such that the follower may be positioned by positioning the contact surface;

a plunger connected to the main spool, and at least partially within a solenoid, whereby the solenoid is operatively coupled to the main spool for positioning the main spool; and a spring operatively coupled to an end of the follower on an opposite side of the follower from the contact surface, thereby biasing the contact surface to protrude from the manifold;

wherein the follower and the main spool are configured to define blockable flow passages between the first input passage and each of the output passages, and between the second input passage and each of the output passages.

19. The control valve of claim 18, wherein the spring is also operatively coupled to the plunger.

20. The control valve of claim 18, further comprising a retaining ring around the follower, wherein the retaining ring acts as a stop to limit protrusion of the contact surface from the manifold.

21. A single-stage fluid flow control valve comprising:

a manifold having a first input passage for coupling to a high pressure line, a second input passage for coupling to a low pressure line, and a pair of output passages for coupling to respective chambers of an actuator;

a follower and a main spool independently slidable within the manifold;

a plunger connected to the main spool, and at least partially within a solenoid, whereby the solenoid is operatively coupled to the main spool for positioning the main spool, and a cage in the manifold, wherein the cage has openings therethrough, and wherein the follower and the main spool are independently slidable within the cage;

wherein the follower has a contact surface protruding from the manifold, such that the follower may be positioned by positioning the contact surface; and wherein the follower and the main spool are configured to define blockable flow passages between the first input passage and each of the output passages, and between the second input passage and each of the output passages.

22. The control valve of claims 21, wherein the cage is a stepped cage.

23. A single-stage fluid flow control valve comprising:

a manifold having a first input passage for coupling to a high pressure line, a second input passage for coupling to a low pressure line. and a pair of output passages for coupling to respective chambers of an actuator, a cage in the manifold, wherein the cage has openings therethrough, a follower and a main spool independently slidable within the cage, wherein the main spool is also slidable with the follower;

a spring operatively coupled to an end of the follower on an opposite side of the follower from a contact surface of the follower, thereby biasing the contact surface to protrude from the manifold such that the follower may be positioned by positioning the contact surface; and a plunger connected to the main spool, and at least partially within a solenoid, whereby the solenoid is operatively coupled to the main spool for positioning the main spool;

wherein the follower and the main spool are configured to define blockable flow passages between the first input passage and each of the output passages, and between the second input passage and each of the output passages.

24. The control valve of claim 23, wherein the main spool has a spool bore therethrough forming part of at least one of the flow passages.

25. The control valve of claim 24, wherein the input passages and the output passages are arrayed substantially linearly in a side-by-side arrangement within the manifold, wherein the flow passages include a connection via the spool bore between one of the input passages and one of the output passages that is not adjacent to the one of the input passages.

26. The control valve of claim 24, wherein the spool bore is in communication with a plunger bore through the plunger.

27. The control valve of claim 24, wherein the cage is a stepped cage.

28. The control valve of claim 24, wherein the contact surface is a flat contact surface that is substantially perpendicular to an axis of the follower, whereby the flat contact surface is configured to engage a cam.

* * * * *